United States Patent [19]

Bertucci et al.

[11] Patent Number: 4,987,752

[45] Date of Patent: Jan. 29, 1991

[54] HIDE SKIVING MACHINE

[75] Inventors: Franco Bertucci, Ramiseto; Romano Burani, Carpi; Raffaele Facchi, Modena, all of Italy

[73] Assignee: S.P.A. Luigi Rizzi & C., Modena, Italy

[21] Appl. No.: 272,859

[22] Filed: Nov. 18, 1988

[30] Foreign Application Priority Data

Nov. 24, 1987 [IT] Italy ..... 22748 A/87

[51] Int. Cl.[5] ..... C14B 1/22; C14B 17/14

[52] U.S. Cl. ..... 69/9.5; 69/38; 69/42

[58] Field of Search ..... 69/9, 9.5, 21.5, 37, 69/38, 42

[56] References Cited

U.S. PATENT DOCUMENTS

| | | | |
|---|---|---|---|
| 592,952 | 11/1897 | Evans | 69/38 |
| 2,451,561 | 10/1948 | Knowlton et al. | 69/37 |
| 3,911,703 | 10/1975 | Repetto | 69/37 |

*Primary Examiner*—Wm. Carter Reynolds

*Attorney, Agent, or Firm*—Guido Modiano; Albert Josif

[57] ABSTRACT

A hide skiving machine adapted to skive a hide in one pass constituted by a frame which supports, at its sides, a rotatable support cylinder upon which the hide is fed and is held in place by a slidable presser roller. A lower oscillating frame having a rotating lower blade cylinder and an upper oscillating frame having a rotating upper blade cylinder are furthermore provided which skive the hide. The oscillating frames are independently movable between a raised non-working position and a lowered working position by respective actuators. Each blade cylinder is provided with a sharpening assembly which maintains the blade sharpness for more effective skiving. An adjustable, flexible front shield and a feed table are furthermore provided. The oscillating frames which support the blade cylinders are also provided with play recovery elements which help maintain the position of the blade cylinders with respect to the hide. The support cylinder can also be provided with supporting elements which allow for the inclination of the axis of the support cylinder relative to the axes of the blade cylinders, thereby providing more effective sharing of hides with variable thicknesses.

21 Claims, 7 Drawing Sheets

HIDE SKIVING MACHINE

BACKGROUND OF THE INVENTION

The present invention relates to a hide skiving machine.

So-called skiving machines are used in processing hides; such machines skive the hide on the side known as "split" to give the hide a constant thickness, removing clots or lumps.

These machines have a pair of closely arranged cylinders with parallel axes; one cylinder, known as the support cylinder, is smooth, and the other is fitted with blades which wind in a spiral pattern on its surface; the hide is driven between said cylinders with the side to be skived directed towards the blade cylinder; the rapid rotation of the blade cylinder provides the required skiving action, while the other cylinder bucks and feeds the hide.

In order to retain the hide effectively while it is treated by the blade cylinder, there is also a further presser roller adapted to secure the hide against the support cylinder.

In known machines it is therefore necessary to insert a hide and retain it between the support cylinder and the presser roller during the treatment of one of its halves, and to subsequently extract it, turn it around and then insert it again to skive its second half, while the hide is held by its already skived part.

This method therefore requires the frequent intervention of manual labor to move the hide, not just when it is loaded into the machine but also in an intermediate moment of its processing, and is therefore onerous and particularly slow.

SUMMARY OF THE INVENTION

The problem thus arises of providing a machine which skives in a single pass, without requiring manual interventions on the hide after it has been loaded into the machine, and which furthermore ensures that the operator is protected from contact with its moving parts, removes the skived material abraded during the treatment and moves away the skived hide. These results are achieved by the present invention, which provides a hide skiving machine characterized in that it comprises a frame with sides supporting a rotatable support cylinder and an upper oscillating frame having a first blade cylinder and a lower oscillating frame having a second blade cylinder, said oscillating frames being independently movable between a raised position, in which the respective blade cylinders are spaced from said support cylinder, and a lowered or work position, in which the cylinders are at a short distance from said support cylinder, in working contact with a hide arranged thereon, actuator means being provided to lift and lower the oscillating frames in successive steps to position their related cylinders in work position or in one or more raised positions with respect to said work position, and play recovery means, said machine being adapted to skive the hide in a single pass without turning it around.

The upper frame is constituted by a pair of lever elements, respectively pivoted to the opposite sides of the supporting structure of the machine in their middle region; said lever elements support, at one of their ends, a motorized blade cylinder and are connected, at their opposite end, to at least one lifting and lowering actuator; means adapted to rigidly rotationally couple the lever elements are furthermore provided. The lower frame is in turn constituted by a pair of lever elements, respectively pivoted to the opposite sides of the supporting structure of the machine, in their middle region; said lever elements support, at one of their ends, a motorized blade cylinder and are connected, at their opposite end, to at least one lifting and lowering actuator; means adapted to rigidly rotationally couple the lever elements are furthermore provided.

In one embodiment, the upper frame has a single lifting and lowering actuator; a shaft connects the lever elements and is coaxial to the pivoting axis of said elements to the sides and is adapted to rigidly rotationally couple the lever elements.

Alternately, the upper frame can have a pair of lifting and lowering actuators which act respectively on the lever elements of the frame, are actuated enbloc and are adapted to rigidly rotationally couple said lever elements.

The upper frame furthermore has a pair of actuators which act on the frame of the machine on the opposite side to the lifting and lowering actuators with respect to the pivoting axis of the upper frame and recover the plays of the supports of said upper frame.

The lower frame has a pair of lifting and lowering actuators which act on the related lever elements of the frame, are actuated enbloc and rigidly rotationally couple said lever elements.

The lower oscillating frame, which supports the related blade cylinder, also supports a sharpening assembly which is rigidly rotationally associated with said frame and is in constant contact with the blade cylinder.

A sharpening assembly is supported in a fixed position on the sides of the machine, and the blade cylinder of the upper frame makes contact with the sharpening means of the sharpening assembly when the upper oscillating frame is rotated to the position in which the blade cylinder which it supports is raised.

Alternately, the sharpening assembly of the upper blade cylinder can be supported by being rigidly associated with the upper oscillating frame, the blade cylinder of the upper frame being constantly in contact with the sharpening means of the sharpening assembly, or the sharpening assembly can be supported in a fixed position on the sides of the machine and comprises a double sharpening grinder.

The actuator means for lifting and lowering the oscillating frames in successive steps both comprise a long-stroke actuator element adapted to lift and lower the related frame, connected in series to a short-stroke actuator element adapted to provide the precision adjustment of the work position of the related blade cylinders.

The long-stroke actuator element is constituted by a hydraulically actuated cylinder-piston assembly, and the related oscillating frame is connected to its related stem; the short-stroke actuator element is constituted by an assembly consisting of an endless screw, a helical gear and a ball screw, the latter being rigidly associated with the cylinder of the cylinder-piston assembly and determining its stroke limit position.

The machine according to the invention comprises shield means adapted to prevent accidental access to the upper blade cylinder when it is in working position; said means comprise at least one shield which is upwardly articularly coupled to the sides of the machine and is connected to the upper oscillating frame by articulated means; the shield is adapted to rotate together with the upper oscillating frame between a raised position, adapted to allow access to the machine's work area to feed hides being dressed, and a lowered position, adapted to obstruct the access to the upper blade cylinder; said shield means furthermore form a hood to contain the skiving powders produced.

Means for sucking up the skiving powder removed during the treatment by the upper blade cylinder are also provided; said means are associated with the skiving powder containment hood formed by the protection shield.

BRIEF DESCRIPTION OF THE DRAWINGS

Further details will become apparent from the following description, with reference to the accompanying drawings, wherein.

DESCRIPTION OF THE PREFERRED EMBODIMENTS

Figure 1:
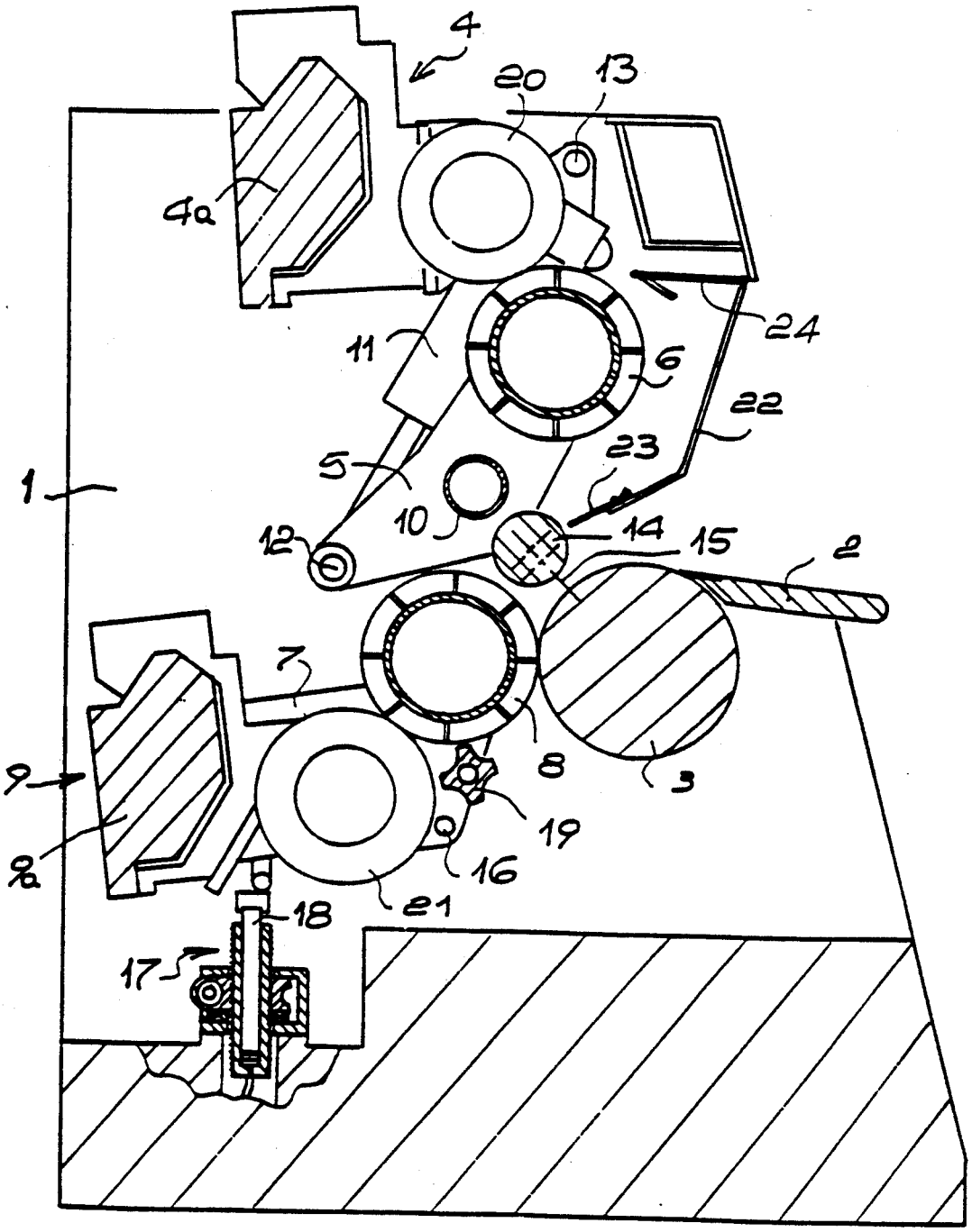
FIG. 1 is an elevated sectional side view of the machine according to the invention in a presetting position.

As shown in FIG. 1, the machine according to the invention comprises a supporting frame having two sides 1 which supports a feed table 2, a support cylinder 3, a fixed upper sharpening assembly 4, a first oscillating frame 5 supporting a first blade cylinder 6, and a second oscillating frame 7 supporting the lower second blade cylinder 8 and the sharpening assembly 9.

Figure 6:
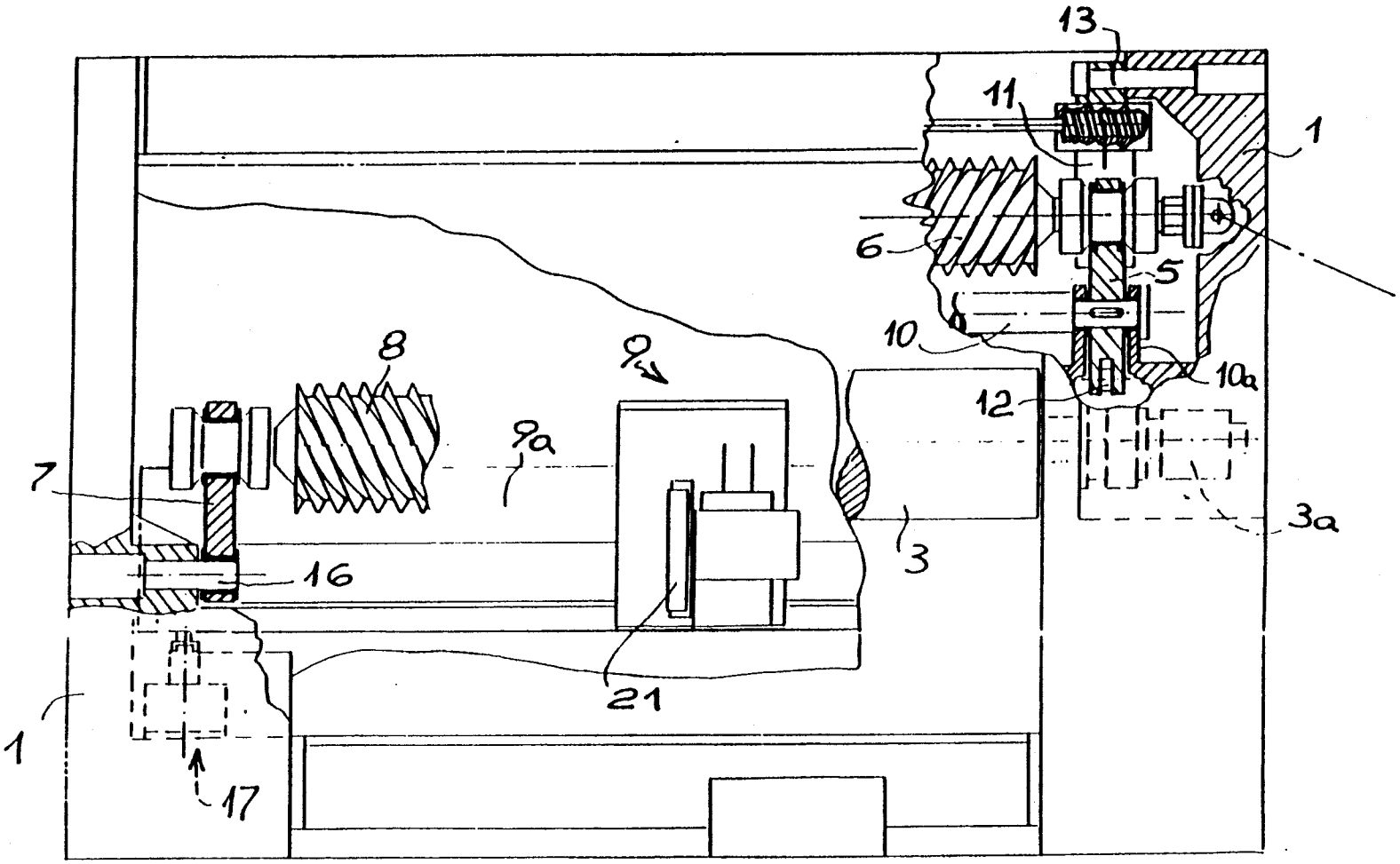
FIG. 6 is a partially sectioned front view of the machine of FIG. 1.

The blade cylinders 6, 8 are rotated by a motor assembly, not illustrated, supported on the frame of the machine, by means of related shafts with universal joints; the axis line of one of said shafts is indicated in FIG. 6.

As shown in FIG. 6, oscillating frame 5 is formed by a pair of lever elements arranged adjacent to the sides 1 and supported by a related shaft 10 rigidly rotationally associated therewith, rotatable about the supports 10*a* of the sides of the supporting frame. The blade cylinder 6, is supported between said lever elements, and an actuator 11 is connected to the end 12 of one of the lever elements which compose the oscillating frame, and is rigidly coupled to the side 1 by a pivot 13 by means of which it can be rotated from the position shown in FIG. 1 to the one shown in FIG. 3.

The shaft 10 makes the lever elements to rotate concordantly eventhough one actuator 11 is provided. However, if the shaft does not provide the required torsional rigidity, two actuators 11 may be connected to the two lever elements of the frame 5 and actuated concordantly.

Figure 2:
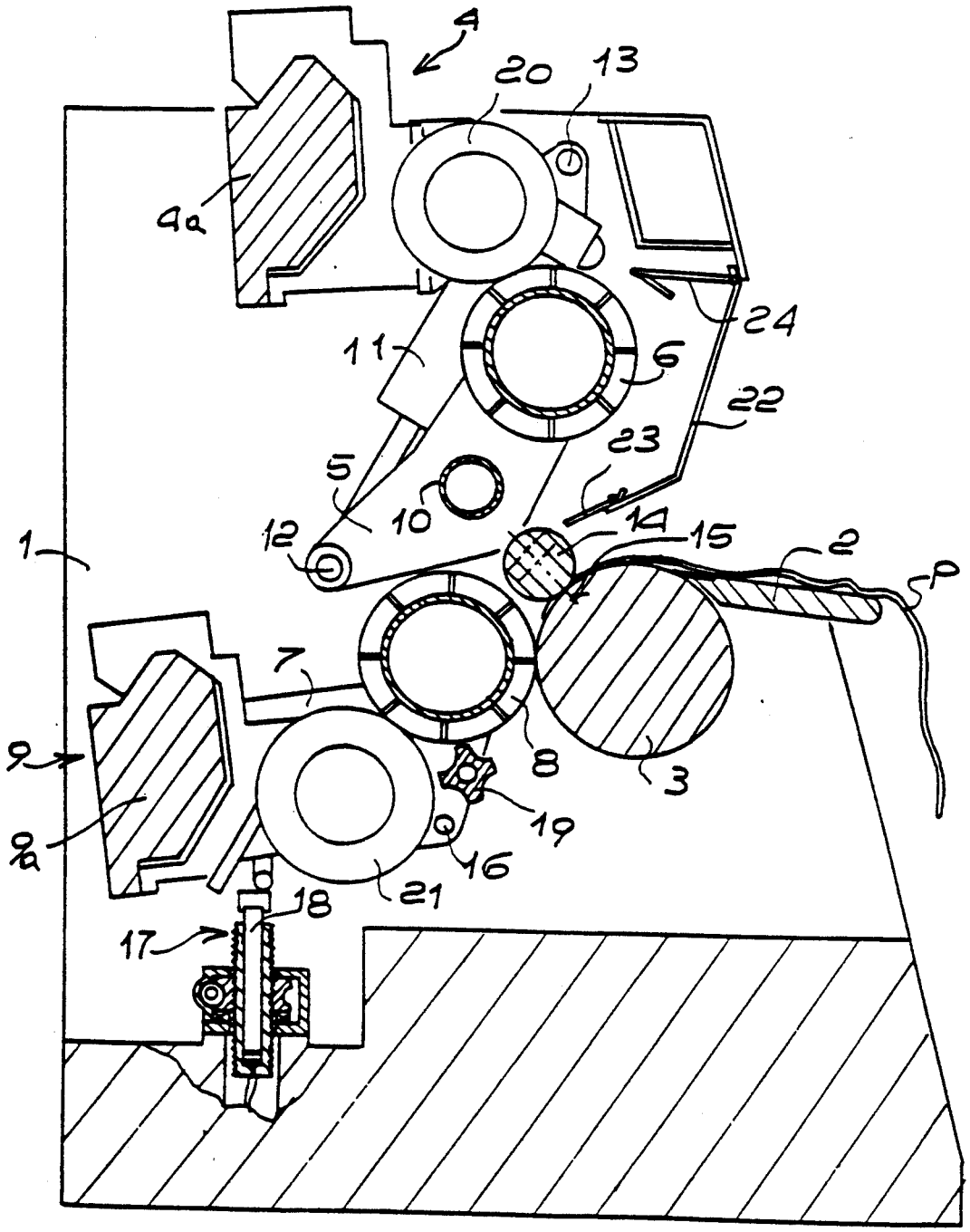
FIGS. 2, 3, 4 and 5 are views similar to that of FIG. 1 of the machine respectively in the first, second, third and fourth steps of the process.
Figure 9:
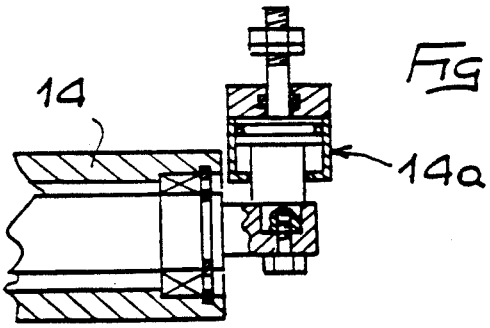
FIG. 9 is a detail view of the coupling of an end of the contrast presser roller.

The sides 1 furthermore support a presser roller 14, having ends supported by respective actuators 14*a*, illustrated in FIG. 9, adapted to translate said cylinder 14 along the line 15, between a raised position illustrated in FIG. 1 and a lowered position shown in FIG. 2.

The oscillating frame 7 is formed by a pair of lever elements arranged adjacent to the sides 1; the blade cylinder 8, is arranged between said lever elements. The lever elements are supported on the sides 1 by respective pivots 16 and a related actuator 17 is provided for each of the lever elements; said actuator is fixed to the sides 1 and rests on the frame 7 by means of its own movable stem 18. The actuator 17 allows to rotate the frame 7 between a closure position, illustrated in FIG. 1, and an opening position, illustrated in FIG. 5, and furthermore takes up slack due to the progressive wear of the blades and allows precise movements during the processing.

The frame 7 supports the lower sharpening assembly 9 and a grooved cylinder 19 adapted to separate the hide from the blade cylinder 8.

The assembly 9 is fixed to the frame 7 and moves together with it.

The sharpening assemblies 4, 9 have respective grinders 20, 21 and are movable parallel to the axis of the cylinders 6 and 8, substantially in a known manner and therefore not described in further detail.

Similarly, the structure which supports the support cylinder 3, the related opening and closure movement means and the motorization elements of said cylinder may be of a known type.

Figure 3:
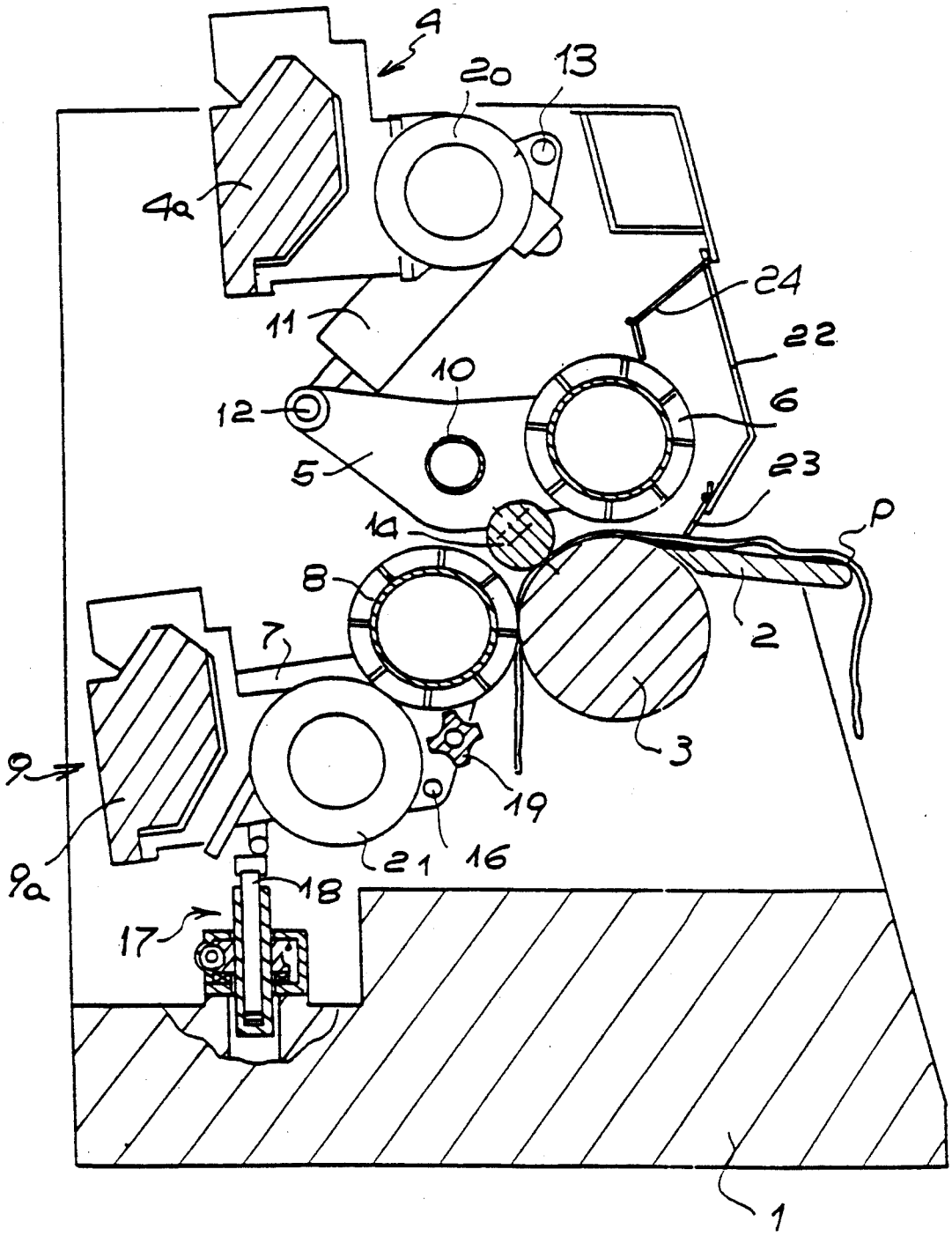

A front shield 22 is connected to the oscillating frame by means of per se known mechanical transmission means, and has, at its lower end, a flexible strip 23, made for example of rubber, adapted to protect the cylinder 6 and to arrange itself in a rearward position when it is lifted, allowing to place the hide to be processed on the table 2, as illustrated in FIG. 1, and adapted to arrange itself in a lowered position, as illustrated in FIG. 3, when the cylinder 6 is lowered and is processing the hide, protecting the operator from accidental contact with the moving cutting and mechanical parts, acting as shield for the skiving material which is produced by the blade cylinder and is scattered around, and furthermore constituting a suction hood 24 connected to an intake fan assembly, not illustrated; said hood 24, which is open towards the blade cylinder 6, allows to remove the skiving shavings produced by said cylinder during the process and to take them away from the work area.

The flexible strip 23 cooperates to this action by outwardly delimiting the suction area by resting on the hide with its lower edge.

The skiving shavings produced by the cylinder 8 fall to the bottom of the machine and move away from the hide without accumulating in the skiving area of the cylinder and can thus be collected and removed mechanically or accumulated and periodically removed.

The support cylinder 3, which is motorized by a related motor 3*a*, for example a hydraulic one, can be supported in a fixed position on the sides of the machine or have movable supports adapted to facilitate the insertion of the hide, said supports furthermore allowing to incline the axis of said cylinder with respect to the axis of the blade cylinders for treatments with differentiated hide thicknesses or of asymmetrical hide parts and the like.

Figure 11:
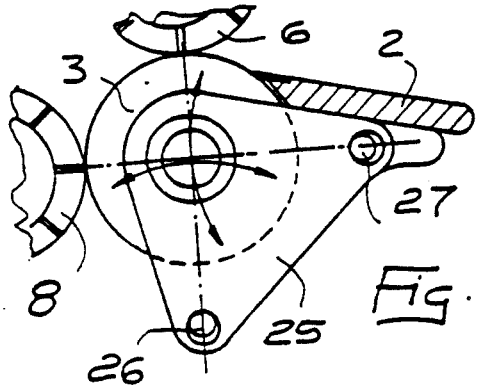
FIG. 11 is a detail view of the supporting structure of the support cylinder.

For this purpose, as illustrated in FIG. 11, it is necessary to be able to adjust the angle formed by the axis of the resting cylinder 3 both with the blade cylinder 8 and with the blade cylinder 6: the support cylinder 3 is therefore supported by a pair of supports 25, each whereof has eccentric elements 26, 27 the rotation whereof allows to adjust the inclination of the cylinder 3 respectively relatively to the blade cylinder 6 and the blade cylinder 8.

It should be noted that due to their small extent these movements, though they actually consist of rotations of the support 25 about the eccentric element, which is kept fixed, as indicated by the arrows of FIG. 11, can be considered substantially rectilinear, and the loss of coplanarity with respect to a blade cylinder when convergence with respect to the other is changed can be considered negligible.

The actuator 11 is constituted by a positioning an element adapted to provide the lifting stroke of the frame 5, associated with an adjusting element for finely adjusting the treatment distance, i.e. the distance from the support cylinder 3 at which the cylinder 6 is arranged.

Figure 7:
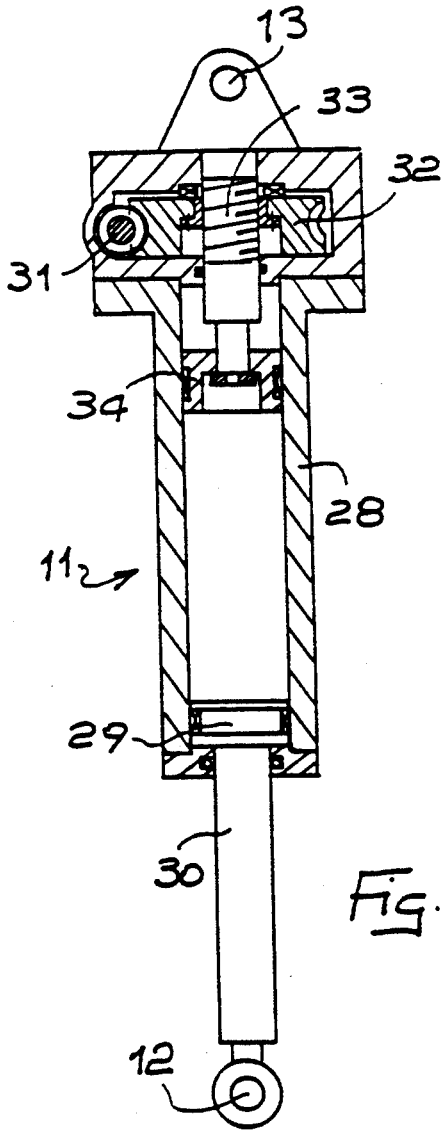
FIG. 7 is a schematic view of the lifting actuator of the upper blade cylinder.

In the embodiment illustrated in FIG. 7, the positioning element providing the lifting stroke is constituted by a hydraulic cylinder 28 inside which there is a piston 29; the pivot 12 for coupling it to the frame 5 is connected to the stem 30 of said piston, and the adjusting element for adjusting the stroke limit position is constituted by an assembly comprising an endless screw 31, a helical gear 32 and a ball screw 33; a piston 34 is connected to the top of the latter and is sealingly slideable within the cylinder 28.

Figure 4:
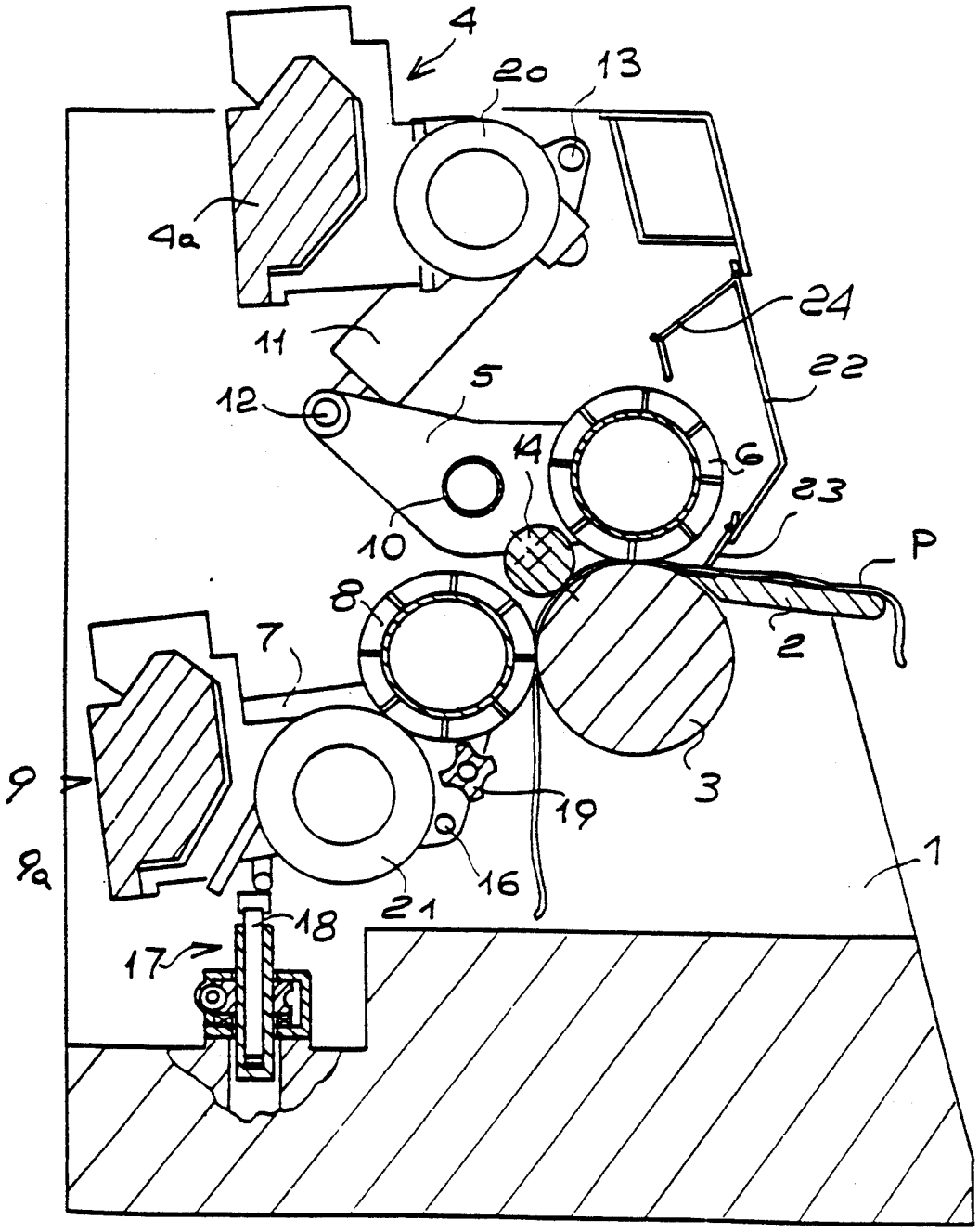
Figure 5:
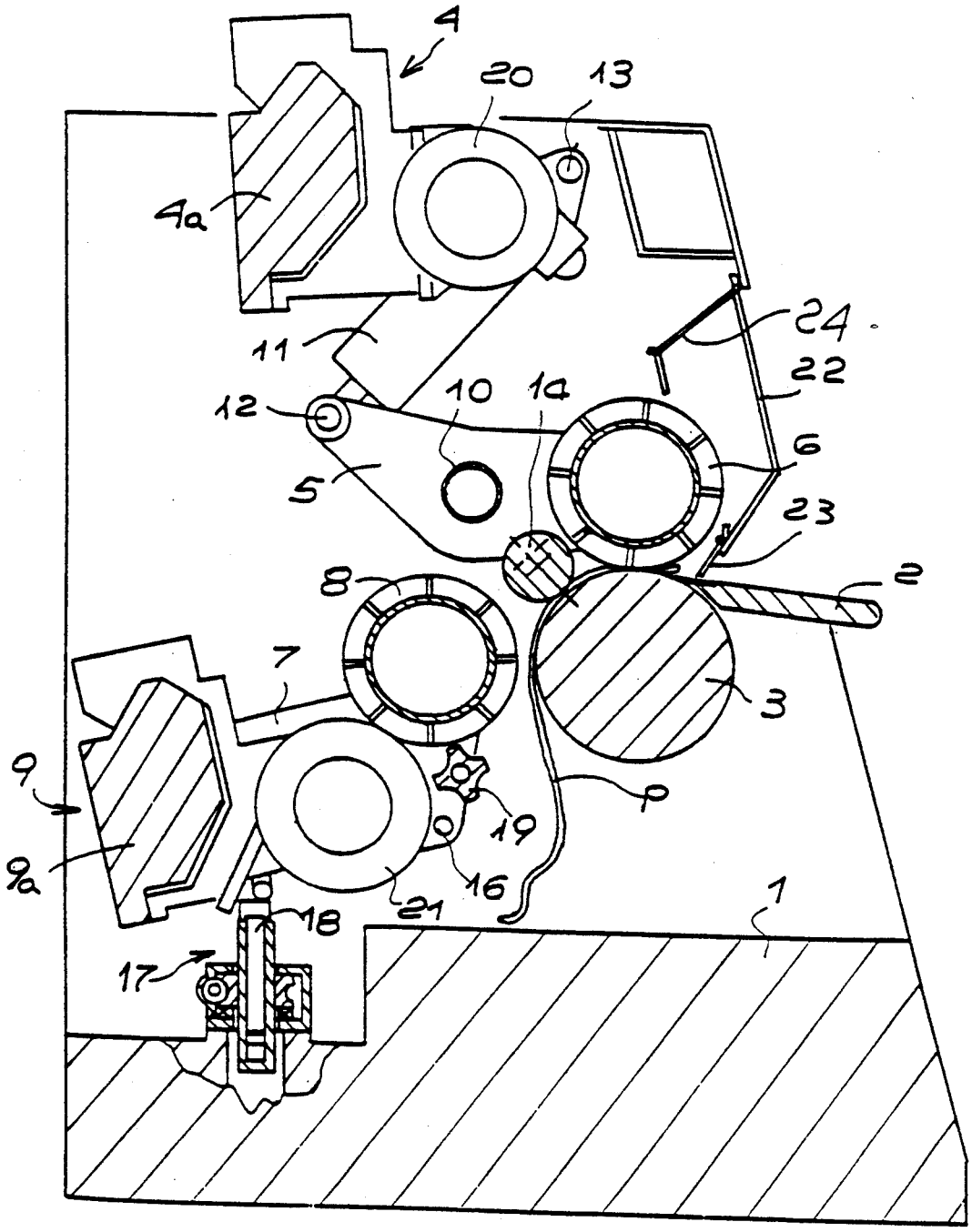

The stroke of said piston 34 is sufficient to provide the final approach of the cylinder 6 to the resting cylinder 3, as illustrated in FIGS. 4, 5.

Figure 8:
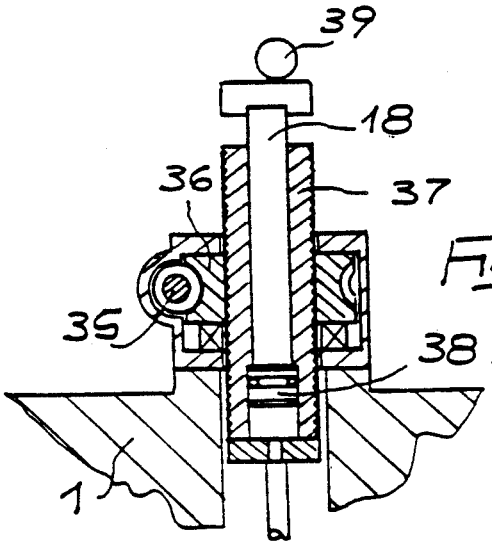
FIG. 8 is a schematic view of the lifting actuator of the lower blade cylinder.

The actuator 17 is in turn constituted by an element for adjusting the working position of the blade cylinder 8, said element being constituted, in the illustrated embodiment FIG. 8, by an endless screw 35 associated with a helical gear 36 inside which a ball screw 37 is rotatable.

The screw 37 constitutes the cylinder for a singleaction hydraulic piston 38 on the stem 61 whereof the frame 7 rests with an articulated coupling 39.

Figure 10:
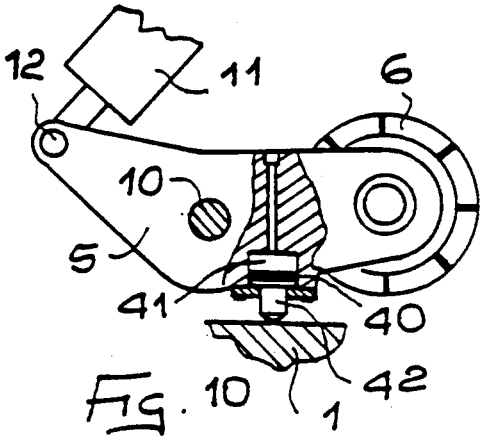
FIG. 10 is a partially sectioned detail view of the lever frame which supports one of the blade cylinders, with a play recovery element.

The oscillating frame 5, which supports the blade cylinder 6, is supported on related supports 10*a*; if it is not corrected, the presence of plays in these supports 10*a* leads, during treatment, to a variation in the position of the blade cylinder, which lifts from the hide being treated; to avoid this, each lever element of the oscillating frame 5 is provided with play recovery means, FIG. 10 constituted by a hydraulic piston 40 which is slideable in a related cylindrical seat 41 of said oscillating frame 15, the stem 42 of said piston rests on the supporting frame 1 on the opposite side to the pivot 12 with respect to the shaft 10 when the frame 5 is in its lowered position.

In this manner the piston 40 acts in contrast with the weight of the frame 5 and of the blade cylinder 6, lifting the frame 5 until the plays in the support 10*a* have been recovered completely, allowing the blade cylinder to keep the position initially set by the actuator 11 even during processing.

In the process cycle of a hide with the machine according to the invention, initially the machine is arranged as illustrated in FIG. 1, with the blade cylinder 6 and the rubber-covered roller 14 in raised position, while the blade cylinder 8 is in working position: in these conditions the operator lags the hide P on the table 2, arranging it with the grain side downwards, and then starts the support cylinder 3 and the descent of the rubber-covered roller 14, which arranges itself so as to secure the hide against the cylinder 3.

In this manner the hide is advanced towards the blade cylinder 8, which is arranged in working position as illustrated in FIG. 2, and during the beginning stage of the shearing cycle the skiving begins.

At the same time, or after a preset delay, the blade cylinder 6 is lowered, as illustrated in FIG. 3, and arranges itself at a short distance from the hide being processed, without however making contact therewith. The movement of the front shield 22 is associated with the descent of the cylinder 6, said shield arranging itself to delimit the work area of the cylinder 6.

The hide is skived with this arrangement for most of its extension, until a reference area of said hide proximate to its end, for example the breast point, arranges itself approximately at the level of the blade cylinder 6: the operator then lowers the cylinder 6 to its working position, as shown in FIG. 4, so that the cylinder 6 can start to skive the final portion of the hide, i.e. the head.

During the middle stage of the shearing cycle, the blade cylinder continues to skive until it reaches the breast point of the hide, where the cylinder 6 started its skiving, and from this position onwards it gradually rises, moving away from the resting cylinder 3, so as to not interfere with the further advancement of the hide P and not damage it, as illustrated in FIG. 5, while during the final stage of the shearing cycle the blade cylinder 6 completes the skiving of the end portion of the hide.

When the skiving is complete, the hide thus moves beyond the rubber-covered roller 14 and is released, falling to the lower region of the machine, from which it is manually removed or carried away by means of a conveyor belt to be then stacked, possibly after being cleaned of the skiving powder.

Freed from the hide, the machine is again set in the position of FIG. 1, allowing access in order to place a new hide to be processed. As shown in the figures, the sharpening assembly 9, with its related grinder 21, is mounted on the same frame 7 which supports the blade cylinder 8: in this manner it is possible to continuously sharpen the blades of the cylinder 8 during the skiving by virtue of the continuous rotation of the grinder 21 combined with its movement along the related supporting beam 9*a*.

The sharpening assembly 4 is fixed on the sides 1; the cylinder 6 makes contact with its grinder 20, which sharpens it by rotating and moving along the related supporting beam 4*a*, only for the time during which the blade cylinder 6 is in raised position. This is due to the fact that the cylinder 6 operates on a limited portion of hide, substantially for a length corresponding merely to the portion of the cylinder 3 comprised between the rubber-covered roller 14 and the blade cylinder 8, and the cutting edge of its blades is therefore subject to considerably less wear than the cutting edge of the blade cylinder 8 which skives most of the extension of each hide.

However, if a greater sharpening of the blade cylinder 6 is desirable, the sharpening assembly 4 can be mounted on the frame 5, similarly to the assembly 9, or a double grinder or similar constructive solutions can be adopted.

The structure of the sharpening assemblies and the other elements of the machine may be of a known kind and are therefore not described in detail. The invention is susceptible to numerous modifications and variations without thereby abandoning the scope of the invention in its general characteristics.

We claim:

1. Hide skiving machine adapted to skive a hide in a single pass comprising: a supporting frame with sides, a rotatable support cylinder supported by said sides of said supporting frame, an upper oscillating frame having a first blade cylinder and a lower oscillating frame having a second blade cylinder, said oscillating frames being independently movable between at least one raised position, in which said blade cylinders are spaced away from said support cylinder, and a lowered-work position, in which said blade cylinders are at a short distance from said support cylinder and are in skiving contact with said hide arranged on said support cylinder, actuator means to position said oscillating frames and thereby related said blade cylinders in said lowered-work position and in said at least one raised position, wherein said actuator means comprise a positioning element adapted to lift and lower related said oscillating frame, and an adjusting element connected in series to said actuator means and adapted to provide a precision adjustment of said work position of related said blade cylinder.

2. Hide skiving machine according to claim 1, wherein said positioning element is constituted by a hydraulically actuated cylinder-piston assembly consisting of a cylinder and a piston with a stem, related said oscillating frame being connected to said stem, and wherein said adjusting element is constituted by a fine-adjustment assembly consisting of an endless screw, a helical gear and a ball screw, said ball screw being rigidly associated with said cylinder and determining a stroke limit position of said cylinder-piston assembly.

3. Hide skiving machine according to claim 1, further comprising shield means adapted to prevent an accidental access to said upper blade cylinder when said upper blade cylinder is in said lowered-work position, said shield means comprising at least one shield upwardly connected to said sides of said supporting frame and connected by mechanical transmission means to said upper oscillating frame, said shield being adapted to rotate together with said upper oscillating frame between said at least one raised position, thereby preventing said accidental access to said upper blade cylinder, said shield means furthermore forming a suction hood which contains skiving shavings produced during operation of said machine.

4. Hide skiving machine according to claim 1, wherein said upper frame is constituted by a pair of lever elements and a related shaft, said lever elements being rigidly joined to each other, at middle regions thereof, by said related shaft, said related shaft being rotatable in a pair of related supports in said sides of said supporting frame, said pair of lever elements rotatably supporting, at ends thereof, said first blade cylinder, said actuating means being connected to an opposite end of at least one of said lever elements, said actuating means providing a simultaneous rotation of said pair of lever elements about an axis of said related shaft.

5. Hide skiving machine according to claim 4, wherein each lever element of said pair of lever elements is provided with play recovery means which correct plays that occur in said related supports when said upper oscillating frame is in said lowered-working position, thereby maintaining said first blade cylinder in a correct working position, said play recover means comprising a hydraulic piston with a stem and a cylindrical seat provided in said each lever element at a point between said middle portion and said end which supports said first blade cylinder, said hydraulic piston being slidable in said cylindrical seat, said stem being in contact with said supporting frame.

6. Hide skiving machine according to claim 1, wherein said lower frame is constituted by a pair of lever elements rotatably pivoted, respectively at middle regions thereof, to opposite sides of said supporting frame, said pair of lever elements rotatably supporting, at ends thereof, said second blade cylinder, said actuating means being connected to an opposite end of at least one of said lever elements, said actuating means providing a simultaneous rotation of said pair of lever elements about pivot points at said middle regions of said lever elements.

7. Hide skiving machine according to claim 1, wherein said lower oscillating frame additionally supports a sharpening assembly, said sharpening assembly having a grinder being in continuous contact with said second blade cylinder.

8. Hide skiving machine according to claim 1, wherein a sharpening assembly having a grinder is supported on said sides of said supporting frame, said first blade cylinder making contact with said grinder of said sharpening assembly when said upper oscillating frame is in said at least one raised position.

9. Hide skiving machine according to claim 1, wherein said upper oscillating frame additionally supports a sharpening assembly, said sharpening assembly having a grinder being in continuous contact with said first blade cylinder.

10. Hide skiving machine according to claim 1, wherein said rotatable support cylinder is provided with movable supports on said sides of said supporting frame, each one of said movable supports being provided with at least two rotatable eccentric elements, a rotation of said eccentric elements allowing for an adjustment of an axis of said supporting cylinder relative to axes of said first blade cylinder and said second blade cylinder, thereby providing a more effective shearing of said hide.

11. Hide skiving machine adapted to skive a hide in a single pass comprising: a supporting frame with sides, a rotatable support cylinder supported by said sides of said supporting frame, an upper oscillating frame having a first blade cylinder and a lower oscillating frame having a second blade cylinder, said oscillating frames being independently movable between at least one raised position, in which said blade cylinders are spaced away from said support cylinder, and a lowered-work position, in which said blade cylinders are at a short distance from said support cylinder and are in skiving contact with said hide arranged on said support cylinder, actuator means to position said oscillating frames and thereby related said blade cylinders in said lowered-work position and in said at least one raised position, wherein a shearing cycle of said machine is comprised of a beginning stage, a middle stage and a final stage, and during said beginning stage of said shearing cycle, said second blade cylinder is in said lowered-work position and said first blade cylinder is in said at least one raised position, and during said middle stage of said shearing cycle, said second blade cylinder is in said lowered-work position and said first blade cylinder is also in said lowered-work position, and during said final stage of said shearing cycle, said second blade cylinder is in said at least one raised position and said first blade cylinder is in said lowered-work position.

12. Hide skiving machine according to claim 11, wherein said actuator means comprise a positioning element adapted to lift and lower one of said oscillating frames, and an adjusting element connected in series to said actuator means and adapted to provide a precision adjustment of said work position of related one of said blade cylinders associated with said one of said oscillating frames.

13. Hide skiving machine according to claim 12, wherein said positioning element is constituted by a hydraulically actuated cylinder-piston assembly consisting of a cylinder and a piston with a stem, said one of said oscillating frames being connected to said stem, and wherein said adjusting element is constituted by a fine-adjustment assembly consisting of an endless screw, a helical gear and a ball screw, said ball screw being rigidly associated with said one of said blade cylinders and determining a stroke limit position of said cylinder-piston assembly.

14. Hide skiving machine according to claim 11, further comprising shield means adapted to prevent an accidental access to said upper blade cylinder when said upper blade cylinder is in said lowered-work position, said shield means comprising at least one shield upwardly connected to said sides of said supporting frame and connected by mechanical transmission means to said upper oscillating frame, said shield being adapted to rotate together with said upper oscillating frame between said at least one raised position, thereby preventing said accidental access to said upper blade cylinder, said shield means furthermore forming a suction hood which contains skiving shavings produced during operation of said machine.

15. Hide skiving machine according to claim 11, wherein said upper frame is constituted by a pair of lever elements and a related shaft, said lever elements being rigidly joined to each other, at middle regions thereof, by said related shaft, said related shaft being rotatable in a pair of related supports in said sides of said supporting frame, said pair of lever elements rotatably supporting, at ends thereof, said first blade cylinder, said actuating means being connected to an opposite end of at least one of said lever elements, said actuating means providing a simultaneous rotation of said pair of lever elements about an axis of said related shaft.

16. Hide skiving machine according to claim 15, wherein each lever element of said pair of lever elements is provided with play recovery means which correct plays that occur in said related supports when said upper oscillating frame is in said lowered-working position, thereby maintaining said first blade cylinder in a correct working position, said play recover means comprising a hydraulic piston with a stem and a cylindrical seat provided in said each lever element at a point between said middle portion and said end which supports said first blade cylinder, said hydraulic piston being slidable in said cylindrical seat, said stem being in contact with said supporting frame.

17. Hide skiving machine according to claim 11, wherein said lower frame is constituted by a pair of lever elements rotatably pivoted, respectively at middle regions thereof, to opposite sides of said supporting frame, said pair of lever elements rotatably supporting, at ends thereof, said second blade cylinder, said actuating means being connected to an opposite end of at least one of said lever elements, said actuating means providing a simultaneous rotation of said pair of lever elements about pivot points at said middle regions of said lever elements.

18. Hide skiving machine according to claim 11, wherein said lower oscillating frame additionally supports a sharpening assembly, said sharpening assembly having a grinder being in continuous contact with said second blade cylinder.

19. Hide skiving machine according to claim 11, wherein a sharpening assembly having a grinder is supported on said sides of said supporting frame, said first blade cylinder making contact with said grinder of said sharpening assembly when said upper oscillating frame is in said at least one raised position.

20. Hide skiving machine according to claim 11, wherein said upper oscillating frame additionally supports a sharpening assembly, said sharpening assembly having a grinder being in continuous contact with said first blade cylinder.

21. Hide skiving machine according to claim 11, wherein said rotatable support cylinder is provided with movable supports on said sides of said supporting frame, each one of said movable supports being provided with at least two rotatable eccentric elements, a rotation of said eccentric elements allowing for an adjustment of an axis of said supporting cylinder relative to axes of said first blade cylinder and said second blade cylinder, thereby providing a more effective shearing of said hide.

* * * * *